United States Patent [19]

Edwards

[11] 4,119,081

[45] Oct. 10, 1978

[54] FIREPLACE ENCLOSURE AND INTEGRAL HEAT-EXCHANGER

[75] Inventor: Harrison F. Edwards, Norwich, N.Y.

[73] Assignee: Sunbeam Corporation, Chicago, Ill.

[21] Appl. No.: 809,185

[22] Filed: Jun. 23, 1977

[51] Int. Cl.[2] ..... F24C 15/10

[52] U.S. Cl. ..... 126/140; 126/202

[58] Field of Search ..... 126/121, 120, 132, 140, 126/200, 202, 203, 138, 141, 198, 298, 164, 153 B

[56] References Cited

U.S. PATENT DOCUMENTS

| | | | |
|---|---|---|---|
| 2,161,723 | 6/1939 | Rutland | 126/121 |
| 3,938,496 | 2/1976 | Kampf et al. | 126/121 |
| 4,008,704 | 2/1977 | Petrie | 126/121 |
| 4,058,107 | 11/1977 | Edwards | 126/132 |
| 4,060,196 | 11/1977 | Goldsby et al. | 126/121 X |
| 4,076,011 | 2/1978 | Proulx | 126/121 |

*Primary Examiner*—Dennis L. Taylor

*Attorney, Agent, or Firm*—H. Gibner Lehmann; K. Gibner Lehmann

[57] ABSTRACT

A combination fireplace enclosure and heat-exchanger unit of the retro-fit variety, for providing supplemental heat to room areas external to a fireplace, comprising an enclosure frame having closure doors, and a series of elongate heat-transfer members carried by the frame and constituted of relatively high thermally conductive material such as aluminum, disposed side by side, and having portions extending rearwardly from the frame in a position directly above the fire so as to absorb heat therefrom. Other portions of the members extend forwardly through an aperture in the frame and terminate as a series of spaced-apart radiating fins of relatively large expanse and disposed at the front of the frame. Air from the room is thus heated by these fins, through conduction and radiation. A ventilating hood is provided, to partially conceal the fins and shield them from inadvertent contact with personnel in the room. A baffle carried by the frame directs hot gases from the fire toward and past the absorption portions of the members, to maximize heat-transfer thereto. The closure doors carried by the frame minimize heat loss from the room, due to air therefrom being drawn up the chimney. As a result, there is realized higher heating efficiency than was possible with other heat-extracting units of the type intended to be used with fireplaces.

20 Claims, 11 Drawing Figures

110
14
96
24
98
22
24
17
26
28
100
92
94
86
104
16
18
28
38
26
24
20
24
12

17
32
110
26
19
100
24
16
21
38
30
68
70
56
40
58
62
64
6
10
8
22
18
120
114
122
116
28
60
118

FIREPLACE ENCLOSURE AND INTEGRAL HEAT-EXCHANGER

CROSS-REFERENCES TO RELATED APPLICATIONS

1. Copending application in the name of Harrison F. Edwards, U.S. Ser. No. 701,689, filed July 1, 1976 and entitled COMBINATION ISOBARIC STEAM HEATER AND ENCLOSURE FOR USE WITH FIREPLACES.

2. Copending application in the name of Harrison F. Edwards, U.S. Ser. No. 809,186, filed June 23, 1977 and entitled FIREPLACE ENCLOSURE AND HEAT-EXCHANGER UNIT.

BACKGROUND

This invention relates generally to fireplace accessories, and more particularly to devices adapted for use with an existing fireplace installation, for improving the heating efficiency thereof.

Various heat-extraction systems for fireplaces have been proposed in the past few years, and have met with only moderate success. Some devices incorporated hollow coal-cradling gratings through which air or water circulated. Blowers and the like were used with some prior units, while others employed natural convection.

One of the problems associated with virtually all prior installations was that the efficiency of the heat-extracting process was extremely low. With many of the forced air gratings which were used, the front of the fireplace had to be open, to provide the necessary convection. Under such circumstances, large quantities of air from the room were drawn up the chimney, only to be replaced by colder air which seeped into the room from the outside. The small amount of heat obtained from such gratings did not nearly compensate for the loss up the chimney. As a result, the overall heating capacity of such arrangements was low. Moreover, in systems where heat was extracted from the coals, as in the case of a circulating-air type grate, the combustion efficiency of the fire was diminished, since the useful heat which was being extracted from the coals lowered their temperature. This has been found to detract from the overall performance of the heating system, since less heat per pound of fuel is being produced.

Efforts to limit the flow of air from the room by the use of glass enclosures greatly increased the combustion efficiency of the fire, but with such arrangements most of the heat contained in hot gases from the fire was still being drawn up the chimney.

In cases where water was pumped into a casing contained in the firebox for heating, the external plumbing associated therewith was usually aesthetically unattractive, as well as representing substantial costs involved with installation and maintenance. Alteration of the physical layout of the fireplace proved to be a costly measure, and was best avoided, if at all possible.

SUMMARY

The above disadvantages and drawbacks of prior fireplace heat-extraction systems are obviated by the present invention which has for an object the provision of a novel and improved combination fireplace enclosure and heat-exchanger unit of the retro-fit variety, which is simple in construction, reliable in operation, and which can be readily installed in an existing fireplace structure in a relatively short time.

A related object is the provision of a unit as above which is characterized by high heating efficiency, wherein much of the heat from the hot gases of the fire is effectively transferred to the room and wherein the loss of heat from the room due to convection up the chimney is greatly minimized.

Still another object is the provision of a conduction-type heating unit for a fireplace, which is completely self-contained and which requires no special ducts or heating fixtures, and which requires no alteration of the fireplace physical structure during installation or use, thereby making the unit especially adaptable for addition into existing installations.

Still another object is the provision of a heating unit as above which can be readily installed by unskilled personnel, thereby making it available to large numbers of consumers at an advantageously low overall cost.

The above objects are accomplished by a combination fireplace enclosure and heat-exchanger unit comprising a fireplace enclosure frame, thermally conductive heat-absorbing means constituted of high heat conductivity metal, carried by the frame and mounted at the rear thereof, so as to be disposed above the fire and receive heat therefrom, and a large plurality of thermally conductive heat-radiating elements carried by the frame and mounted at the front thereof, so as to be exposed to air circulating in the room and to transfer heat thereto. In addition, there are provided thermally conductive means carried by the frame and constituted of high heat conductivity metal, connecting the heat-absorbing means to the radiating elements to provide for heat-transfer therebetween.

The enclosure frame has closure doors which effectively limit the flow of air to the fire, thus greatly minimizing heat loss resulting from air in the room being drawn up the chimney. However, heat from the hot gases of the fire is effectively absorbed in the exchanger unit and thereafter transferred to the room through the radiating elements, such that high heating efficiency is realizeable, in a retro-fit system.

Both the enclosure frame and the exchanger unit can be made as an integral unit, which can be readily installed with a minimum of effort, and with little or no modification of the existing fireplace structure being required.

Other features and advantages will hereinafter appear.

In the drawings, illustrating several embodiments of the invention:

Figures 1, 4, 7, 8, 9:
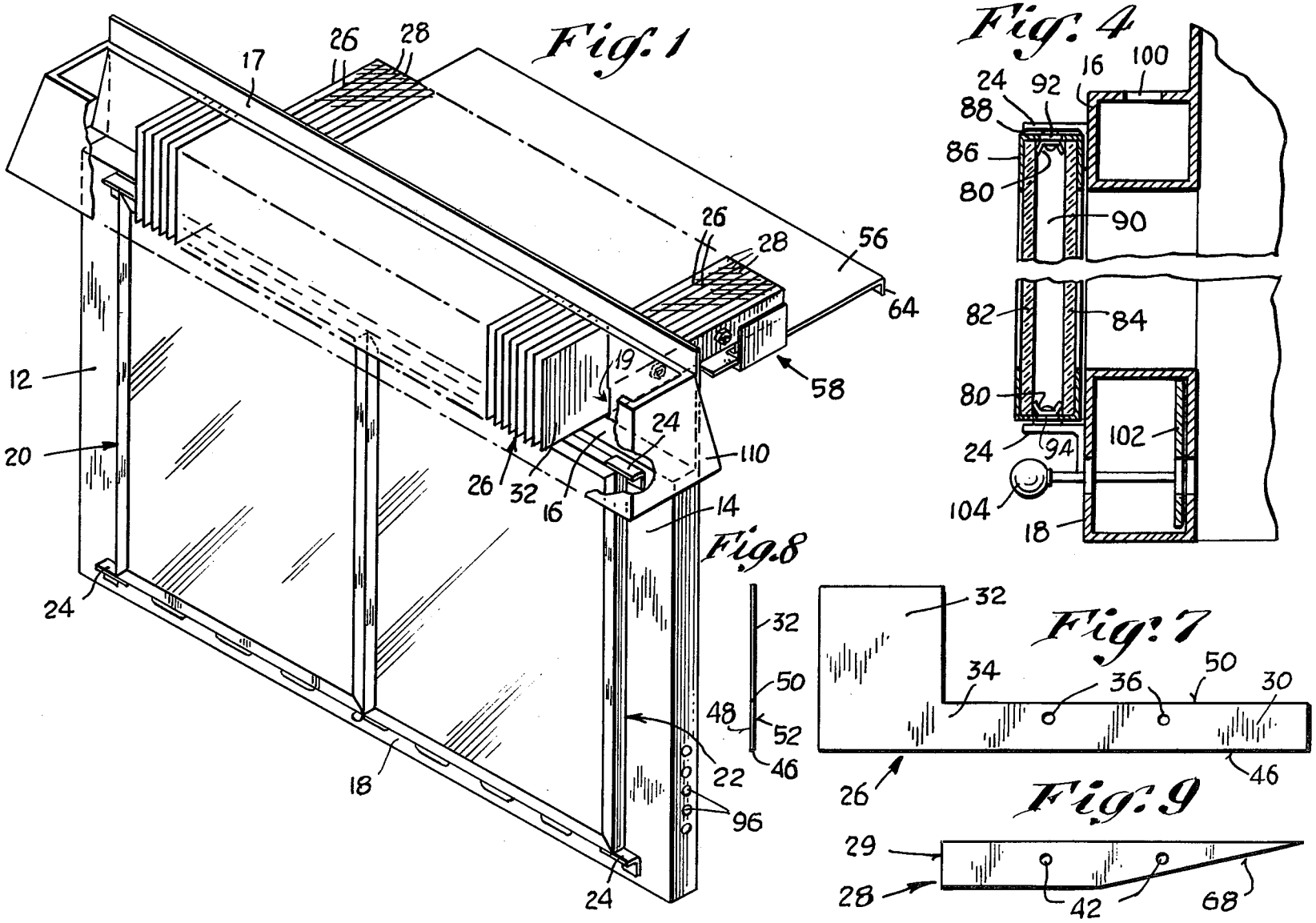
FIG. 1 is a perspective view of the improved combination fireplace enclosure and heat-exchanger unit of the present invention.
FIG. 4 is a fragmentary vertical section, somewhat enlarged, of the fireplace enclosure, per se, of the unit of FIG. 1.
FIG. 7 is a side elevational view of one of the heat-transfer members employed in the unit of FIG. 1.
FIG. 8 is an end view of the heat-transfer member of FIG. 7.
FIG. 9 is a side elevational view of one of the spacer members associated with the heat-transfer members, one of which is shown in FIG. 7.

Referring to FIG. 1, there is illustrated a fireplace enclosure comprising a frame having substantially vertical side members 12, 14, and horizontal top and bottom members 16, 18, in conjunction with doors 20, 22 carried by means of hinges 24 that are secured to the members 12, 14. The member 16 includes an upstanding flange 17.

Figures 3, 5, 6, 10, 11:
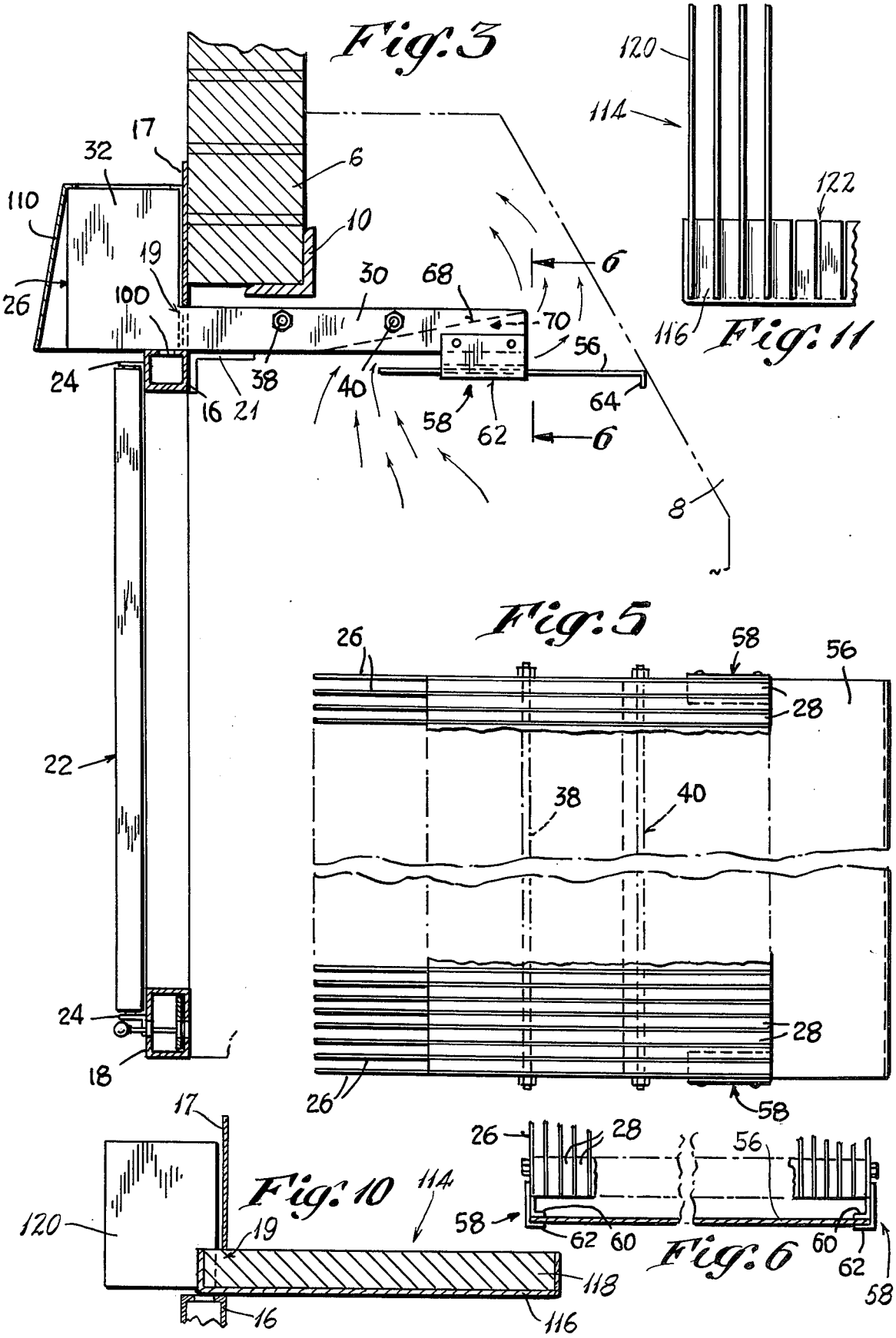
FIG. 3 is a view, partly in side elevation and partly in vertical section, of the unit of FIG. 1.
FIG. 5 is a top plan view of the heat-exchanger unit portion, per se, of the combination unit shown in FIGS. 1–3.
FIG. 6 is a section taken on line 6—6 of FIG. 3.
FIG. 10 is a vertical section of a modified heat-exchanger unit adapted to be substituted for the one shown in FIGS. 1-3, the modified exchanger unit constituting another embodiment of the invention.
FIG. 11 is a fragmentary front elevational view of the modified heat-exchanger unit of FIG. 10.

In accordance with the present invention, there is provided a novel and improved heat-exchanger unit associated with the fireplace enclosure, for providing supplemental heat to areas external to the fireplace. The combination enclosure and heat-exchanger unit is adapted to be used with an existing fireplace structure, as a retro-fit addition thereto. In FIG. 3, the unit is shown installed in a fireplace having brickwork 6, a back wall 8, and a lintel bar 10 for supporting the brickwork. The heat-exchanger unit comprises a series of heat-transfer members 26, one of which is particularly illustrated in FIG. 7. The members 26 are disposed broadside to one another as in FIG. 1, in a stacking relationship, and a series of spacer members 28 having ends 29, is interposed between portions of the members 26 as illustrated in FIG. 5.

Referring again to FIG. 7, the member 26 has the configuration of the letter L, and comprises a heat-absorbing portion 30, a heat-radiating portion 32 of large expanse, and a thermally conductive connecting portion 34. In some of the appended claims, the portions 30 are referred to as elongate coextensive conductive strips, the portions 32 being designated heat-radiating elements, and the portions 34 being labeled bridges. As provided by the invention the member 26 is constituted of metal having a high thermal conductivity, such as copper or aluminum. In addition, the member 26 includes two mounting holes 36 adapted to receive two tie rods 38, 40 when a series of the members 26 and 28 is assembled. The spacer member 28 includes mounting holes 42 through which the tie rods 38, 40 extend. Small brackets 21 secure the stack of members 26, 28 to the top member 16 of the frame. As shown in FIG. 8, the conductive strips 30 provide four heat-absorbing surfaces 46, 48, 50 and 52, which are adapted to come in contact with the hot gases of the fire and to absorb a substantial amount of available heat therefrom. The upstanding flange 17 of the member 16 has a rectangular aperture 19 extending for a large portion of the width of the enclosure. The bridges or thermally conductive connecting portions 34 are seen to extend through this aperture and are closely juxtaposed to the walls thereof, whereby minimum space exists between the portions 34 and the walls of the aperture for air to leak into the fireplace from the room. Also, the ends 29 of spacer members 28 extend forwardly (to the left in FIG. 3) at least partially through the aperture 19, such that no spaces exist by which heated air from the room can be sucked into the fireplace. Accordingly, air flow to the fire can be closely controlled (limited) to provide maximum combustion efficiency.

Further in accordance with the invention there is provided a damper in the form of a plate 56 carried by two small brackets 58 which are bolted or welded to the oppositely disposed members 26 of the stack. The brackets 58 are shown in FIG. 6, and have flange portions 60, 62 forming a channel, in which the opposite edge portions of the damper 56 are slidably received. The brackets 58 can be formed by two angle members, welded to one another in the position shown, to form the channels for the damper. The rearmost edge of the damper is seen to include a stiffening flange 64. The above arrangement enables the damper to be slidably adjusted with respect to the brackets 58 and the enclosure frame, such that the flange 64 engages the back wall of the particular fireplace with which the unit is being used. Such engagement is clearly illustrated in FIG. 3.

Referring again to FIG. 7 it will be seen that the spacer member 28 has an inclined heat-absorbing surface 68 which provides a series of relieved areas 70 (FIG. 3) when the members 26 and 28 are arranged in a stack as shown in FIG. 1. With the particular arrangement of damper 56 shown, hot gases from the fire are prevented from rising and by-passing the heat-absorbing portions 30 of the members 26. Instead, with the damper flange 64 engaging the back wall 8 of the fireplace, such gases are channeled forwardly (toward the left in FIG. 3), past the front edge of the damper 56, and past the inclined surfaces 68 of the spacer members 28, and the exposed side surfaces 48, 52 and under surfaces 46 of the heat-absorbing portions 30. This flow is diagrammatically shown by a series of arrows in FIG. 3, and is seen to be generally tangent to the surfaces 46-52, and surfaces 68. Accordingly, with such a construction wherein the spacer members 28 are sandwiched between the thermally conductive portions 34 of the members 26, even that heat absorbed by the spacer members 28 can be transferred by conduction to the radiating elements 32, to provide useful warmth to the room.

As shown particularly in FIG. 4, the door 22 consists essentially of two panes of glass 82, 84 which are disposed in spaced apart parallel relation. Extending completely around the door 22 is a frame or sash 86 constituted as a channel member which confines and conceals the edge portions of the glass panes 82, 84. The panes 82, 84 are maintained in spaced relation by means of a series of spring clips 80 which are riveted to the connecting web portion 88 of the channel member 86. Four clips 80 are used for the door 22, two being carried by th sash 86 adjacent the top member 16, and two being carried by the sash 86 adjacent to the bottom member 18. The door 20 is of similar construction, comprising a pair of spaced apart glass panes disposed in parallel relation, and a sash similar to that designated 86 in FIG. 4.

By virtue of the doors 20, 22 being of double-pane construction, a hotter enclosed fireplace fire can be had with safety, thereby enabling the heat-exchanger unit to provide a higher heating capacity than would be possible were single-paned glass door units used.

The panes of glass 82, 84 and sash 86 define an air space 90 through which air can be freely convected, even when the doors 20, 22 are closed. The web portion of the channel or sash 86 comprises a series of slots or ventilating holes 92 in the vicinity of the top member 16. Similarly, a second series of slots 94 is provided in the sash 86, adjacent to the bottom member 18. By such an arrangement, air occupying the space 90 becomes heated due to its proximity to the fire and glass panes 82, 84, and is consequently caused to rise and exit through the ventilating holes 92. In a similar manner, air from the room is drawn into the holes 94 of the sash. There is thus established an upward flow of air from the room, into the air space 90, and out the ventilating holes 92 in the top of the door 22 and back into the room. The remaining door 20 is provided with ventilating holes similar to those designated 92, 94 of the door 22. Such an arrangement has been found to not only provide heat to the room, but in addition, the temperature of the glass panes 82, 84 is maintained at a safe level, due to the cooling effect of the convected air, while enabling a hotter fire to be maintained for purposes of high capacity heating. Experiments have shown that the reduction in temperature of the glass panes can be as much as 200° F. by virtue of the provision of the ventilating holes. Accordingly, the danger of the glass cracking where an excessively hot fire is being employed, is greatly reduced.

Figure 2:
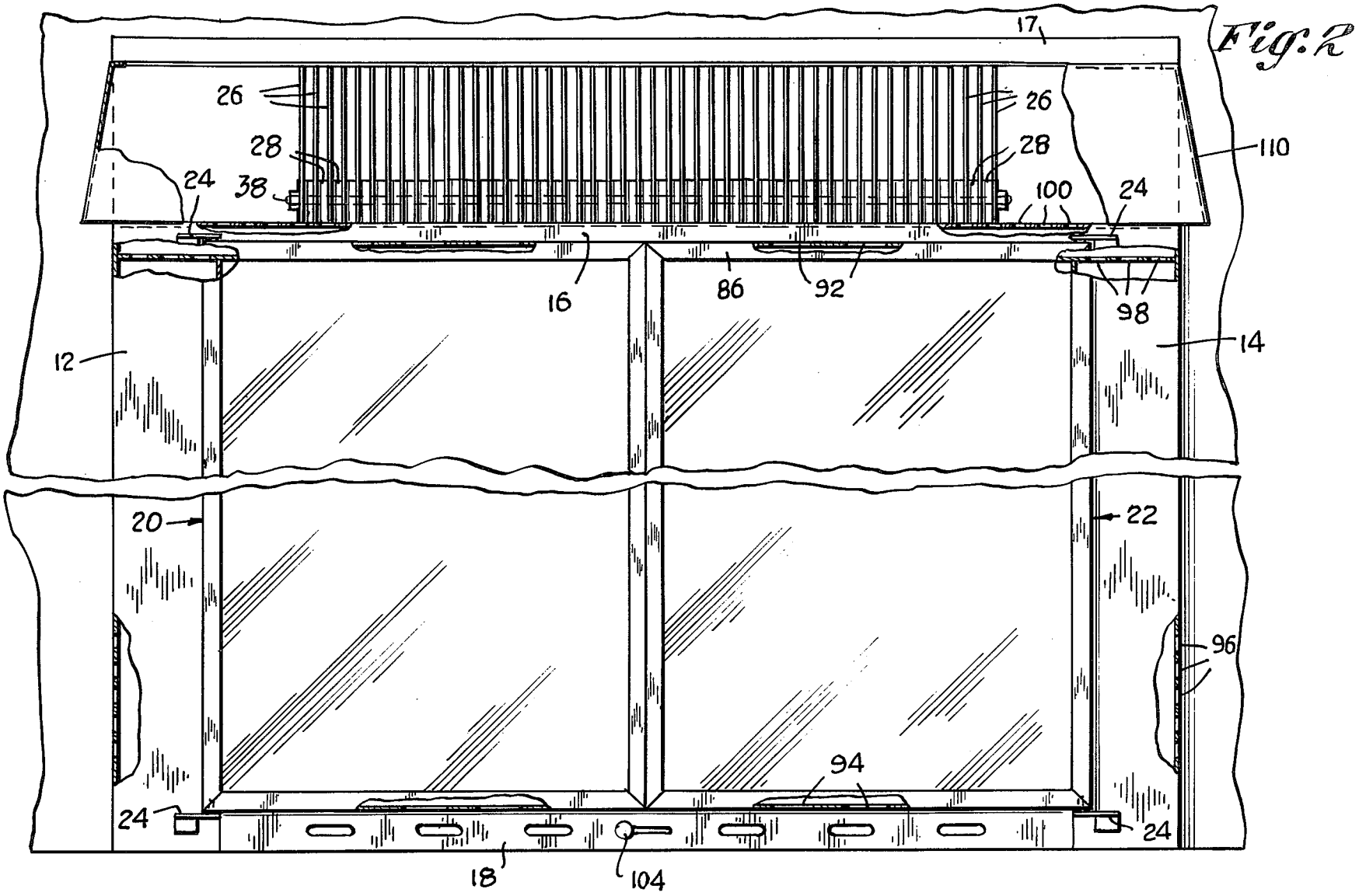
FIG. 2 is a front elevational view of the unit of FIG. 1.

Also, in accordance with the invention, the side members 12, 14 of the fireplace frame are of hollow construction and have the form of box sections. Referring to FIGS. 1 and 2, a series of air inlet or ventilating holes 96 is provided in the side wall of the member 14. The upper end of the member 14 is open, and a series of notches or holes 98 constituting inlet ports is provided in the top member 16 where it joins the vertical side member 14. As shown in FIG. 4, this top member 16 is also in the form of a box section and includes a series of air discharge ports 100 (FIG. 2). By such an arrangement, cold air from the room can flow into the holes 96, up through the hollow interior of the vertical side member 14, through the ports 98 and out the discharge ports 100. This provides a desirable cooling to the enclosure frame, reducing the overall temperature to a safe value, while at the same time providing additional heat to the room.

The bottom member 18 is also constituted as a box section, and includes a shutter or slide 102 which is operated by a handle 104 (FIG. 4).

Referring again to FIGS. 2 and 4, it can be seen that the top and bottom members 16, 18, as well as the side members 12, 14 have front surfaces while lie in a common plane. The doors 20, 22 are seen to overlap the top and bottom members, as well as the side members, thus providing an improved seal over that obtainable where the doors are completely nested between the fireplace frame members. In addition, such construction enables unimpeded flow of air from the room into the air space 90 of the door 22, and out the top ventilation holes 92 (FIG. 2). Accordingly, air flow to the fire is capable of being closely controlled by means of the shutter 102. This is important in providing an optimum air flow to the fire, wherein the combustion efficiency is maximized, and the combustion temperature is greatest. Accordingly, the overlapping construction of the doors 20, 22 and the fireplace frame constituted of the members 12, 14, 16, 18, is seen to be an important feature of the present invention.

Referring again to FIGS. 1, 2 and 3, there is provided a protective hood 110 carried at the front of the enclosure, the hood being of box-like configuration and having an open top and bottom. The hood has an inwardly extending flange surrounding the top opening, the flange resting on the heat-radiating elements 32 of the members 16. The hood serves two purposes. It conceals the radiating elements 32 from view, thereby providing an aesthetically pleasing appearance to the unit. Also, it prevents inadvertent contact with the elements 32 by personnel in the room. Since these elements can attain temperatures upward of 200° F., the shielding provided by the hood is desirable to have from the standpoint of safety.

Another embodiment of the invention is shown in FIGS. 10 and 11, wherein a modified heat-exchanger unit is provided, generally designated by the numeral 114. The unit is adapted to be carried by the top member 16 of the enclosure, and to extend through the aperture in the upstanding flange 17 as in the previous construction. The exchanger unit 114 comprises a flat tray 116 having a series of vertical notches 122 adapted to receive multiple heat-radiating elements in the form of square or rectangular plates 120. The width of the notches is roughly the same as the thickness of the plates, such that the latter can be held in place in the manner of FIGS. 10 and 11 by a force fit. A slab of aluminum 118 is carried in the tray, and is in intimate thermal contact with the plates. During the manufacture of the unit, the aluminum is poured into the tray 116 in a molten state, with the plates 120 in position. The molten aluminum is allowed to flow around the corners of the plates; after it has solidified, the plates are embedded in the slab which was formed. The unit can be secured to member 16 by suitable brackets or struts (not shown). The modified unit 114 is intended to be used with the enclosure frame shown in FIG. 1, and including the hood 110 and the damper 56, which is slidably carried on brackets (not shown in FIG. 10) similar to those designated 58 in FIGS. 3 and 6.

In such a construction, the slab of aluminum constitutes both the heat-absorbing portion and the heat-transfer portion of the heat-exchanger unit, as can be readily understood. By the provision of both the plates and the slab being constituted of aluminum, loosening of the plates due to unequal expansion and contraction with the slab are eliminated. In addition, by virtue of the embedment of the plates in the slab, the heat-transfer process is especially efficient.

The above constructions are seen to have a number of distinct advantages. Since the enclosure and heat-exchanger unit are secured together as an integral system, they can be readily installed in existing fireplace structures by merely sliding them into place, and fastening the enclosure to the lintel with suitable brackets (not shown). This installation is readily accomplished by one person with simple tools, and requires little or no modification of the fireplace structure. The heating efficiency of the system is seen to be high; heat loss from the room is reduced to a low value wherein it can be made negligible compared to the benefits in heat renewed. The double-pane construction of the doors enables a hotter fire to be tolerated without the danger of cracking of the glass. The ventilation provided through the doors and the frame will maintain both at a safe temperature, while providing useful additional heat to the room.

From the above it can be seen that I have provided novel and improved combination enclosure and heat-exchanger units which are simple in construction and reliable in use, in addition to being substantially more effective than prior devices of the type adapted to be used with fireplaces. Accordingly, the unit is seen to represent a distinct advance and improvement in the technology of fireplace heating systems.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention, and certain portions of the inventive improvements may be used without others.

I claim:

1. A combination fireplace enclosure and heat-exchanger unit for providing supplemental heat to room areas external to a fireplace, comprising in combination:

(a) a fireplace enclosure frame and closure doors carried thereby and movable between open and closed positions, (b) a thermally conductive heat absorbing means constituted of high heat conductivity metal, carried by said frame and mounted at the rear thereof, so as to be disposed above the fire and receive heat therefrom, (c) a large plurality of thermally-conductive heat radiating elements carried by said frame and mounted at the front thereof, so as to be exposed to air circulating in the room and to transfer heat thereto, and (d) thermally conductive means carried by the frame and constituted of high heat conductivity metal, connecting said heat-absorbing means to said radiating elements to provide for heat transfer therebetween.

2. The invention as defined in claim 1, wherein:

(a) said heat-radiating elements comprise respectively a plurality of coextensive spaced plates, (b) said heat absorbing means comprising a series of elongate coextensive conductive strips disposed alongside one another, (c) spacer means constituted of heat-conductive material interposed between said strips, (d) at least some of said strips being integral with some of said plates and connected thereto respectively by bridges, said conductive connecting means comprising said bridges, (e) said frame having an aperture in its upper portion, (f) said bridges extending through said aperture, (g) each of said closure doors comprising a rectangular sash and a pair of tempered glass panes carried by the sash and disposed in substantially parallel relation, (h) means for maintaining said pairs of panes in spaced relation with one another, (i) said sash having multiple ventilating openings enabling air from the room to be drawn into the space between the pairs of panes, become heated, and thereafter be returned to the room, (j) said frame comprising two vertical frame members and a horizontal frame member, (k) said vertical members being of hollow construction, having an inner air chamber, and having multiple air inlet passages in their lower portions, to draw air from the room into the chamber, (l) the horizontal frame member being of hollow construction, having an inner air chamber communicating with the air chambers of the vertical members, and further having multiple air outlet passages in its upper portion, for returning heated air from said chambers to the room, (m) means carried by the enclosure frame providing a damper, for channeling hot gases from the fire past said heat-absorbing means to maximize heat-transfer thereto, (n) means connected with the frame and adjustably mounting the damper to enable it to be set to different operative positions, so as to accommodate fireplace structures of different dimensions, (o) said adjustable mounting means comprising a pair of brackets having shoulders slidingly engageable with edge portions respectively of said damper.

3. The invention as defined in claim 1, wherein:

(a) said heat-absorbing means, heat-radiation elements and thermally conductive means comprise a plurality of separate heat-transfer members, disposed in substantially coextensive relation, each of said members having a heat-absorbing portion, a heat-radiating portion, and a thermally conductive portion, all of said portions being integral with one another.

4. The invention as defined in claim 3, wherein:

(a) said heat-absorbing means, heat-radiating elements and thermally conductive means provide a multiplicity of parallel heat-conducting paths from an area at the rear of the enclosure frame to an area at the front of the frame.

5. The invention as defined in claim 1, wherein:

(a) said frame has an aperture in its upper portion, (b) said thermally conductive means extending through said aperture and being closely disposed to the walls thereof, to minimize air flow through the aperture and thus reduce heat loss due to air from the room being drawn up the chimney.

6. The invention as defined in claim 1, and further including:

(a) means carried by the enclosure frame providing a damper, for channeling hot gases from the fire past said heat-absorbing means to maximize heat-transfer thereto.

7. The invention as defined in claim 6, and further including:

(a) means connected with the frame and adjustably mounting the damper to enable it to be set to different operative positions above the fire, so as to accommodate fireplace structures of different dimensions.

8. The invention as defined in claim 3, wherein:

(a) said heat-transfer members have substantially the configuration of the letter L.

9. The invention as defined in claim 3, and further including:

(a) multiple spacer members disposed respectively between said heat-transfer members, to enable free circulation of air in the areas between the heat-radiating portions of said heat-transfer members.

10. The invention as defined in claim 9, wherein:

(a) said spacer members have relieved portions to enable free circulation of hot gases from the fire in the areas between the heat-absorbing portions of said heat-transfer members.

11. The invention as defined in claim 3, and further including:

(a) multiple spacer members disposed respectively between said heat-transfer members, to enable free circulation of air in the areas between the heat-radiating portions of said heat-transfer members, and (b) tie rods extending through at least some of said heat-transfer members and adjacent to said spacer members, for holding them in assembled relation.

12. The device as defined in claim 1, and further including:

(a) a hood carried by the enclosure frame, (b) said hood being open at its top and bottom to enable free flow of air circulating in the room past the heat-radiating elements while at least partially concealing the latter from view and protecting personnel in the room from direct contact therewith.

13. The invention as defined in claim 1, wherein:

(a) each of said closure doors comprises a rectangular sash and a pair of tempered glass panes carried by the sash and disposed in substantially parallel relation, (b) means for maintaining said pairs of panes in spaced relation with one another, (c) said sash having multiple ventilating openings enabling air from the room to be drawn into the space between the pairs of panes, become heated, and thereafter be returned to the room.

14. The invention as defined in claim 1, wherein:

(a) said frame comprises two vertical frame members and a horizontal frame member, (b) said vertical members being of hollow construction, having an inner air chamber, and having multiple air inlet passages in their lower portions, to draw air from the room into the chamber, (c) the horizontal frame member being of hollow construction, having an inner air chamber communicating with the air chambers of the vertical members, and further having multiple air outlet passages in its upper portion, for returning heated air from said chambers to the room.

15. The invention as defined in claim 7, wherein:

(a) said adjustable mounting means comprises a pair of brackets having shoulders slidingly engageable with edge portions, respectively of said damper.

16. The invention as defined in claim 6, wherein:

(a) said heat-absorbing means comprises a series of elongate coextensive conductive strips disposed alongside one another, presenting a plurality of heat-absorbing surfaces, (b) said damper providing means being so disposed as to direct hot gases from the fire in paths generally tangential to said surfaces, so as to maximize contact between the latter and said hot gases.

17. The invention as defined in claim 16, and further including:

(a) a plurality of spacer members interposed respectively between the conductive strips of the heat-absorbing means, (b) said spacer members presenting a plurality of heat-absorbing surfaces, and being thermally coupled to said strips so as to transfer absorbed heat thereto.

18. The invention as defined in claim 16, wherein:

(a) said conductive strips are constituted of aluminum.

19. The invention as defined in claim 1, wherein:

(a) said heat-absorbing means comprises a metal tray carried by the frame, (b) a slab of aluminum disposed in said tray, (c) said heat-radiating elements comprising respectively a plurality of coextensive spaced plates, (d) said tray having a series of notches respectively receiving said plates, (e) at least limited portions of said plates being embedded in the aluminum slab so as to be thermally connected therewith, such that heat absorbed by the aluminum slab is transferred to said plates and thereafter radiated into the room.

20. The invention as defined in claim 19, wherein:

(a) said plates are force-fitted in the notches of said tray, the force-fit constituting a rigid mechanical connection between the plates and tray.

* * * * *